US006679713B2

(12) United States Patent
Miura

(10) Patent No.: US 6,679,713 B2
(45) Date of Patent: Jan. 20, 2004

(54) CONNECTOR FOR A FLEXIBLE CIRCUIT BOARD

(75) Inventor: Kazuto Miura, Kawasaki (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/247,332

(22) Filed: Sep. 20, 2002

(65) Prior Publication Data

US 2003/0060072 A1 Mar. 27, 2003

(30) Foreign Application Priority Data

Sep. 25, 2001 (JP) ..... 2001-290911

(51) Int. Cl.[7] ..... H01R 13/15

(52) U.S. Cl. ..... 439/260; 439/66; 439/67; 439/495; 439/77; 439/767

(58) Field of Search ..... 439/260, 492, 439/493, 495, 329, 630, 66, 67, 637, 632, 77, 267

(56) References Cited

U.S. PATENT DOCUMENTS 6,056,572 A * 5/2000 Matsumoto et al.
6,280,217 B1 * 8/2001 Lin
6,352,442 B1 * 3/2002 Kudo
6,524,124 B2 * 2/2003 Yamane

* cited by examiner

*Primary Examiner*—Anthony Dinkins
*Assistant Examiner*—Nguyen T. Ha
(74) *Attorney, Agent, or Firm*—Antonelli, Terry, Stout & Kraus, LLP

(57) ABSTRACT

A connector (1) for a flexible circuit board (30) has a housing (2), a pressing means (12), and parallel contacts (6) each having a conductive arm (8) and arranged at a pitch to form a row in the recess (3) of the housing. The pressing means (12) can be swung to close the recess so that an inner end portion of the flexible board (30) overlying the conductive arms (8) will be pressed down onto these arms. Reinforcement metals (20) face one another over the row of the contacts (6) and are attached to opposite sides (5) of the housing (2), so as to be soldered to a rigid printed circuit board. Each reinforcement metal (20) has a resilient support (25) for urging upwards the flexible board (30) in a direction away from the conductive arms (8) so as to keep the board in place.

4 Claims, 5 Drawing Sheets

CONNECTOR FOR A FLEXIBLE CIRCUIT BOARD

FIELD OF THE INVENTION

The present invention relates to a connector for use to connect a flexible circuit board to a relatively rigid printed circuit board.

PRIOR ART

Some types of electric connectors known in this field of art are designed each to connect a flexible circuit board to an electronic device, the circuit board being for example a flexible printed cable (FPC) or a flexible flat cable (FFC). Basically, a housing of the known connector has an accessible space in which a plurality of contacts are disposed at regular intervals and in parallel with each other. The known connector comprises also a pressing means that overlies conductive arms of the contacts. This means will be opened and closed to press the flexible circuit board at its end onto these conductive arms. Examples of such a prior art are disclosed for example in Utility Model Laying-Open Gazette No. 6-77186, Japanese Patent No. 3029985 and ibid. No. 3075707 (that corresponds to U.S. Pat. No. 6,056,572).

Generally, those prior art connectors are divided into two groups, that is, the so-called cover type and the so-called slider type. The pressing means in each cover type connector is constructed to swing relative to the housing. In contrast, the pressing means in the slider type is capable of a sliding displacement on and along the housing. From another viewpoint, the prior art connectors for flexible circuit boards are usually of the so-called ZIF (viz., "zero-insertion-force") structure that does not need any noticeable force to pull out the flexible circuit board temporarily placed in the connector, although the Non-ZIF structure is also employed in some cases.

In the connectors of ZIF structure, each flexible circuit board will be put on the conductive arms of contacts at first, but will not be retained in place in any manner until the pressing cover or slider is then operated to take its latching or locking position. Those flexible boards are thus likely to move away from their correct target position due to vibration or the like external force imparted to them, thereby failing to ensure a reliable electric connection. In order to avoid such an undesired displacement of the flexible circuit boards, every operator has to hold them in place with one of his or her hands, while operating the pressing cover or slider with his or her other hand.

The other type connectors of Non-ZIF structure comprising the swing-able pressing cover may be used to diminish this problem. However, the flexible circuit boards having been placed on their target position will not necessarily be surely kept there, also in this case. Rotation and/or rocking of the pressing cover being operated will possibly cause to some degree such an undesirable displacement of said flexible boards as in the case of using the connectors of ZIF structure.

Whichever type the connector for flexible boards is of, its restraint for each board depends on the number of contacts or conductive portions thereof to which it will be pressed by the pressing means. If a pulling force or a transverse pushing force is imparted to the flexible board retained in any connector, then the board will possibly tend to slip off the connector or displace itself a transverse distance. The smaller the number of contacts is, the more serious is such a tendency to cause the problem.

In order to avoid the problem of displacement or slipping off of the flexible circuit boards, apertures or recesses may be formed in them and correspondingly the connector housing may have bosses or latch pawls formed therein. Connectors of this type are disclosed for example in Patent Laying-Open Gazettes No. 10-106694 and No. 2000-182697. Such a latching mechanism will however give rise to another problem that if an extraordinarily strong pulling force accidentally acts on the flexible board, then it or the connector itself will be damaged or broken.

SUMMARY OF THE INVENTION

An object of the present invention made in view of these drawbacks is to provide a connector having contacts for a flexible circuit board, such that once inserted in the connector to overlie conductive arms of the contacts, the inner end portion of the flexible board will elastically and temporarily be retained in place. Further, this connector has to be designed such that its pressing means is operable to force the flexible board into an ultimate fixed and pressed engagement with the connector.

In order to achieve this object, the connector provided herein for use with the flexible circuit board does comprise a housing and a pressing means, wherein the housing has a recess in which a plurality of parallel contacts forming a row and each having a conductive arm are disposed at a given pitch, and the pressing means is operable to open and close the recess such that as it closes the recess, the inner end portion of said flexible board overlying the arms will be pressed down thereto. Characteristically, the connector comprises a pair of reinforcement metals that face one another in the direction of the row and are attached to opposite sides of the housing, so as to be soldered to a relatively rigid printed circuit board, wherein each reinforcement metal has a resilient support for urging upwards the inner end portion of said flexible board in a direction away from the contacts' conductive arms.

The resilient support smoothly continues from the basal end of each reinforcement metal in a cantilevered fashion, the basal end being located beside the recess of housing so as to face the inner end portion of said flexible board being inserted. The resilient support extends obliquely upwards at first into the housing, and is then bent downwards at its inner end region, such that this support generally assumes a reversed and depressed V-shaped in its side elevation.

The resilient supports may be of such a shape that they engage with apertures or cutouts formed in the inner end portion of said flexible board being inserted. In this case, the flexible board will more surely be protected from its slipping off and displacement on one hand, and any excessively strong pulling force or the like external force possibly imparted to the flexible board will cause an elastic deformation of the said supports on the other hand. Thus, said board will be released from its engagement with the connector, thereby protecting them from damage or breakage.

Each reinforcement metal may have, formed integral therewith, a generally semicircular bearing portion for rotatably supporting a fulcrum boss of the pressing means and reinforcing it.

THE PREFERRED EMBODIMENTS

Figure 1:
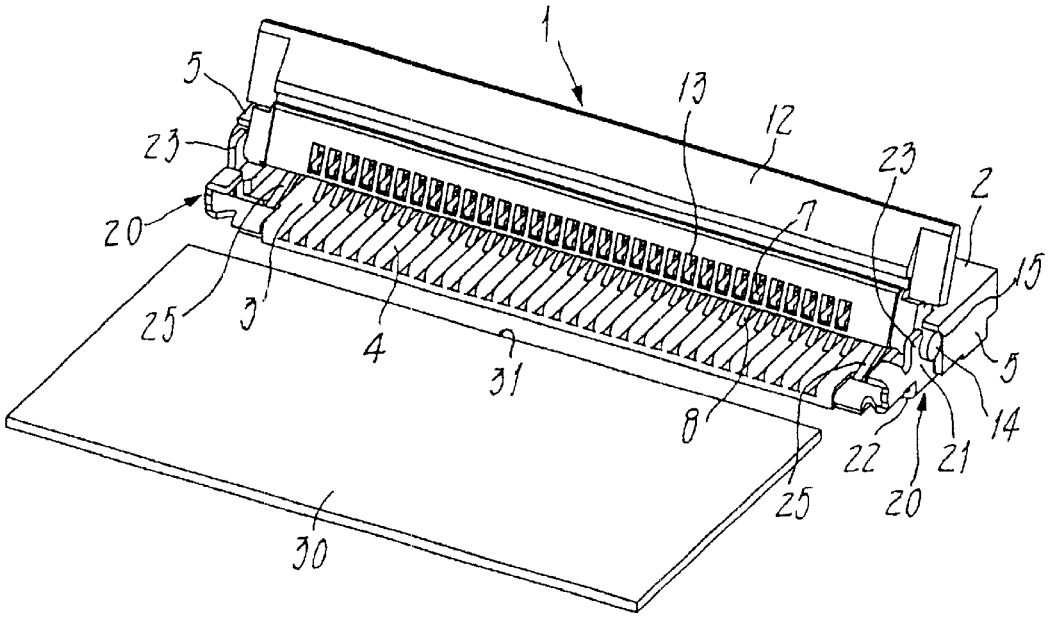
FIG. 1 is a perspective view of a connector provided herein for use with a flexible circuit board shown together with the connector.

Now some embodiments of the present invention will be described in detail, referring to the drawings.

FIGS. 1 to 4 show a connector for use with a flexible circuit board, the connector having compartments formed therein for holding contacts and reinforcement metals.

The connector 1 for the flexible circuit board comprises a housing 2 that is formed of an insulating plastics so as to have a recess 3 opened up in the frontal half of the housing 2. Contact receiving grooves 4 are formed and exposed in the recess 3 in order to receive a plurality of the contacts 6 (see FIG. 3) arranged parallel at regular intervals. Pressing means 12 as detailed below are pivoted in the opposite side walls 5 and 5 of the housing, and the reinforcement metals 20 are attached thereto.

Figure 3:
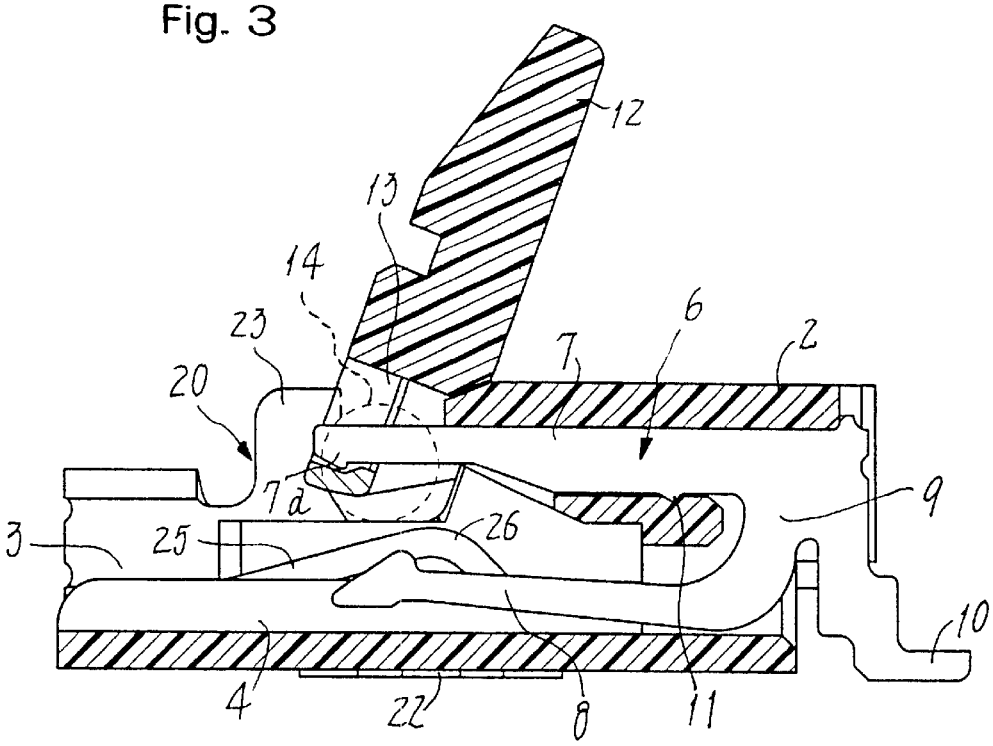
FIG. 3 is an enlarged and cross-sectional side elevation of a compartment formed in the connector for accommodation of a contact.

As shown in FIG. 3, each contact 6 is a bifurcate piece that was made by punching a thin metal plate. A support arm 7 of the contact 6 extends generally in parallel with a contact beam 8 and is integrally connected thereto by a short tie body 9. A lead 10 protrudes from the short body 9 downwards and backwards so that these contacts 6 are inserted from back of the housing 2 and into respective grooves 4. A minute lug 11 of the support arm 7 bites the inner wall of each groove 4 so as to hold each contact in such a state that its support arm 7 and its contact beam 8 are exposed in the recess 3 of housing. Those leads 10 extending out and down from the back of housing 2 will be soldered to points that are included in a circuit pattern printed on a relatively rigid circuit board (not shown), when this connector 1 is surface-mounted thereon.

Similarly to the housing 2, the pressing means 12 is also made of an insulating plastics to be of a lid-like shape for covering the recess 3 of said housing. Apertures 13 are formed in the housing 2 corresponding to the contact receiving grooves 4 so that hook-shaped ends 7*a* of the support arms 7 of contacts 6 held in the housing engage the respective apertures 13. Short columnar studs or bosses 14 and 14 protruding out and sideways from the opposite sides of the pressing means. Concave bearing ends 15 and 15 are formed in the opposite walls 5 and 5 of housing 2, as will be seen best in FIG. 2, so that the bosses 14 are rotatably held each in part in the respective bearing ends 15.

Figure 6:
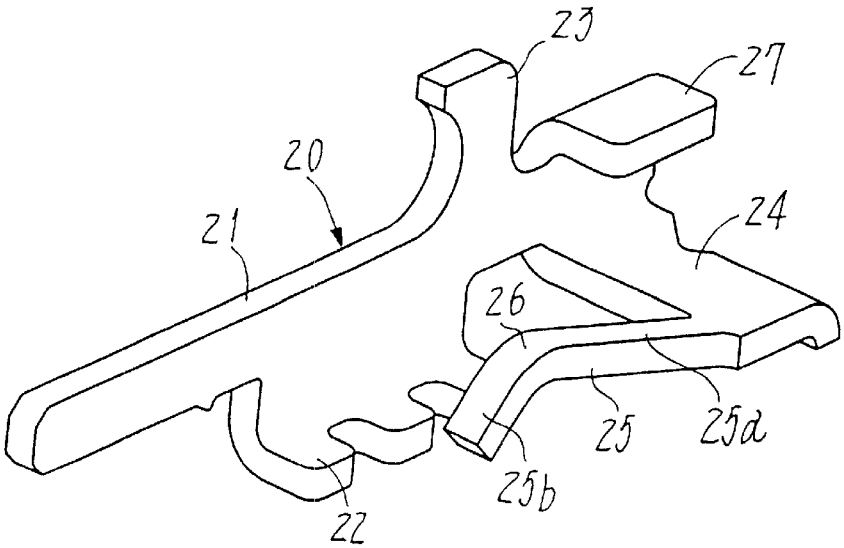
FIG. 6 is an enlarged perspective view of the reinforcement metal.

Reinforcement metals 20 attached to the side walls 5 of housing 2 are made by punching a thin metal plate to form profile pieces, that are then bent each into a configuration as shown in FIG. 6. Five principal portions of each reinforcement metal 20 are a fixed arm 21, a solderable foot 22, a semicircular concave bearing portion 23, a basal end 24, and a resilient support 25. The fixed arm 21 is inserted backwards and deep into an elongate aperture 16 (see FIG. 2) that is formed in the inner region of each side wall 5 of housing 2. The solderable portion 22 is formed by bending inwards a bottom of the metal body continuing forwards from the fixed arm 21, so that this portion extends along the bottom of side wall 5. The bearing portion 23 protrudes up from a rear region of said body continuing from the fixed arm 21 so as to cooperate with the housing's bearing end 15 in rotatably supporting the boss 14 of pressing means 12. The basal end 24 is formed by inwardly bending the lower and foremost end region of the body of reinforcement metal, so that the resilient support 25 protrudes forwards from this basal end. The resilient support 25 whose fore end is formed integral with the basal end 24 extends generally in parallel with the fixed arm 21 in a cantilevered fashion. In detail, the resilient support 25 extends obliquely upwards at first to provide a basal region 25*a*, and is then bent downwards near its rear end to provide an end region 25*b*, such that this support generally assumes a reversed and depressed V-shaped in its side elevation. An upwardly convex summit 26 intervenes between such basal and end regions 25*a* and 25*b*. A reinforcing ear 27 is formed by inwardly bending the upper and foremost end region of the body of reinforcement metal. The reinforcement metal 20 shown in FIG. 6 is for attachment to the right-hand side wall 5 in FIG. 1. Therefore, another reinforcement metal (not shown) for attachment to the left-hand side wall has to be of a shape symmetrical with the illustrated one 20.

Figure 4:
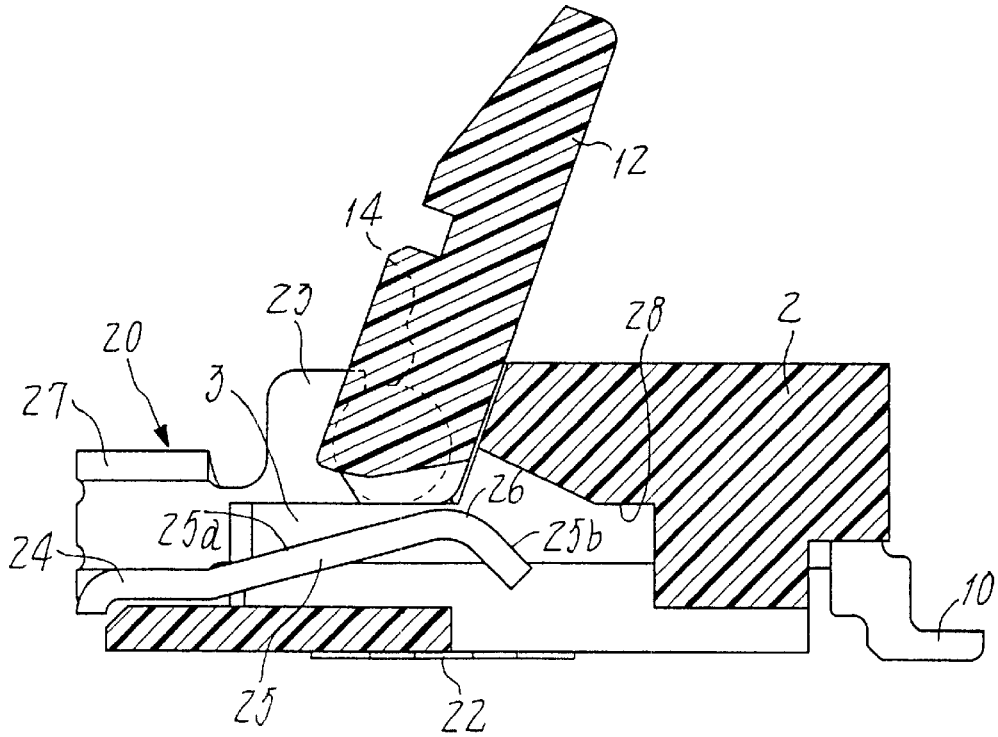
FIG. 4 is likewise an enlarged and cross-sectional side elevation of another compartment formed in the connector for accommodation of a reinforcement metal.

When assembling the connector, both the fixed arms 21 of reinforcement metals 20 will be forced into the respective elongate apertures 16 (see FIG. 2) formed in the inner regions of side walls 5 of housing 2. As shown in FIG. 4, each arm 21 thus fixed in position will have its basal region 25*a* inclined upwardly and inwardly from the fore end opening of recess 3, with its end region 25*b* being inclined down.

Figure 2:
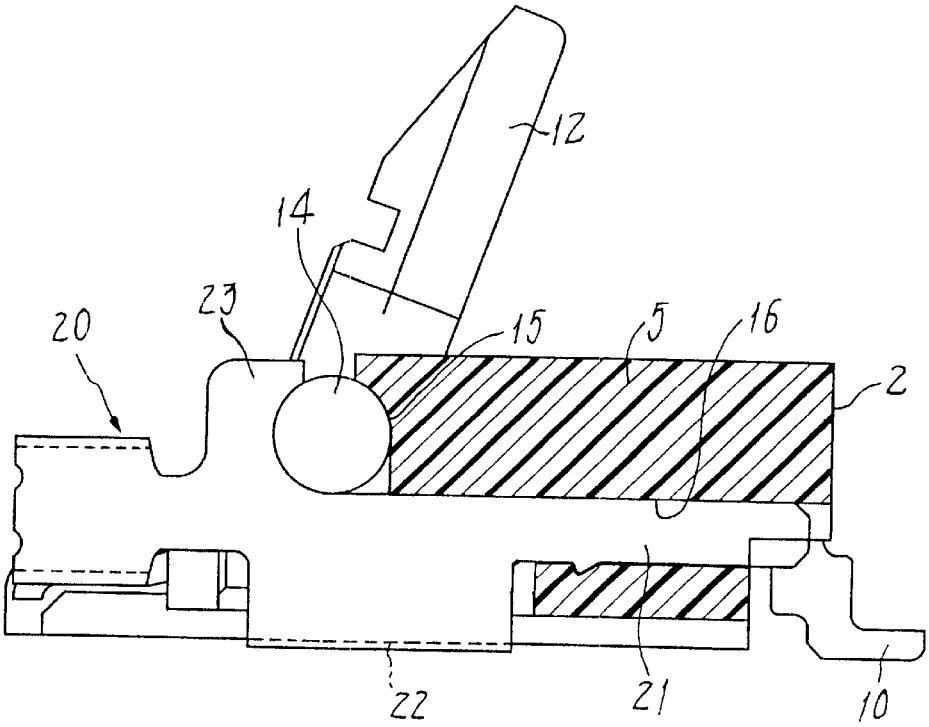
FIG. 2 is an enlarged side elevation of principal portion, of the connector shown fragmentarily in part.
Figure 5:
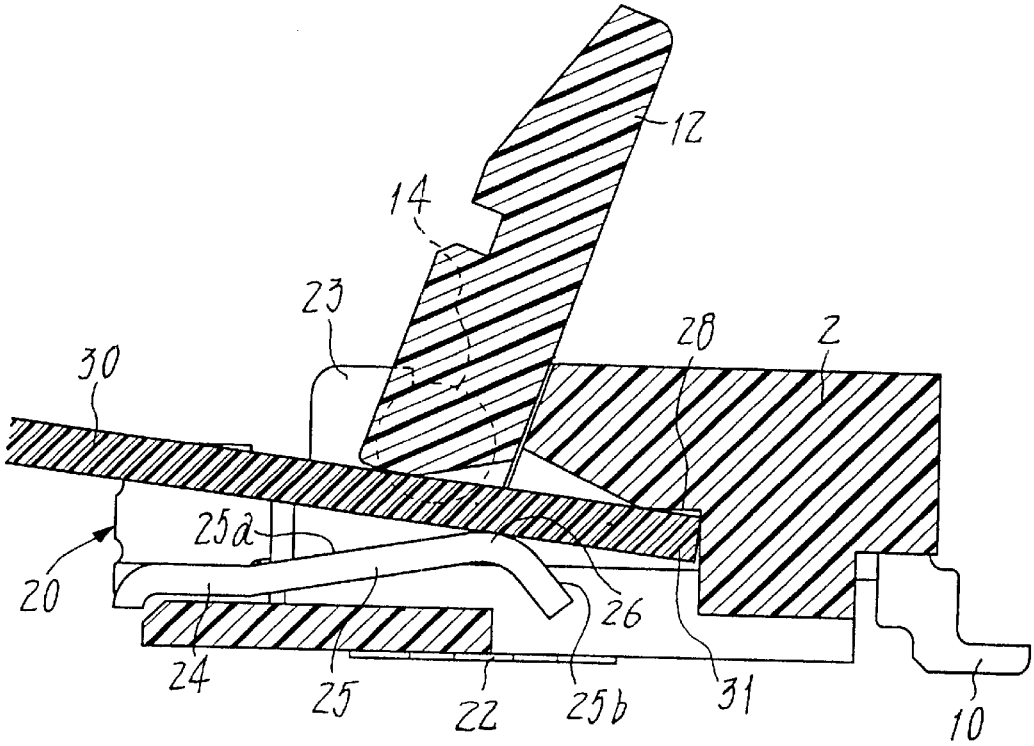
FIG. 5 is a cross-sectional side elevation corresponding to FIG. 4, but showing the inner end portion of a flexible circuit board inserted in the connector.
Figure 7:
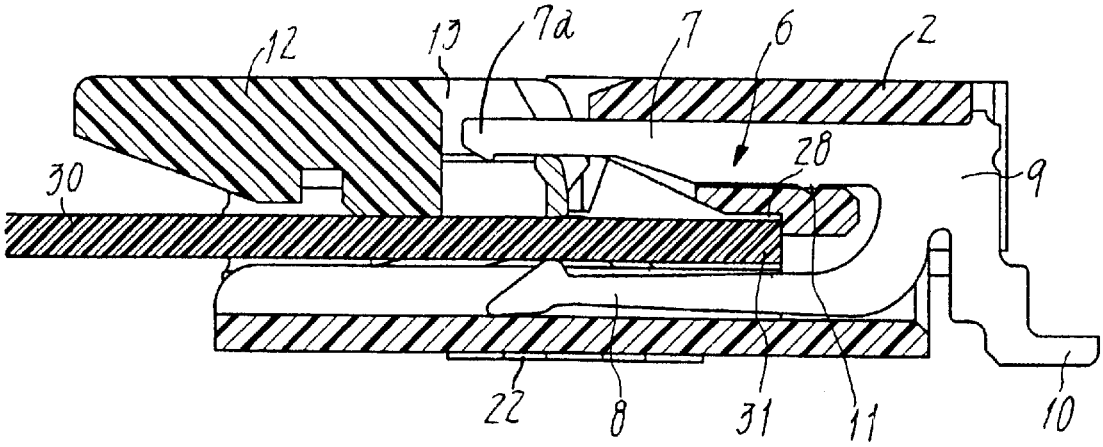
FIG. 7 is an enlarged cross section of the connector whose conductive arms of contacts have been brought into contact with the flexible board.
Figure 8:
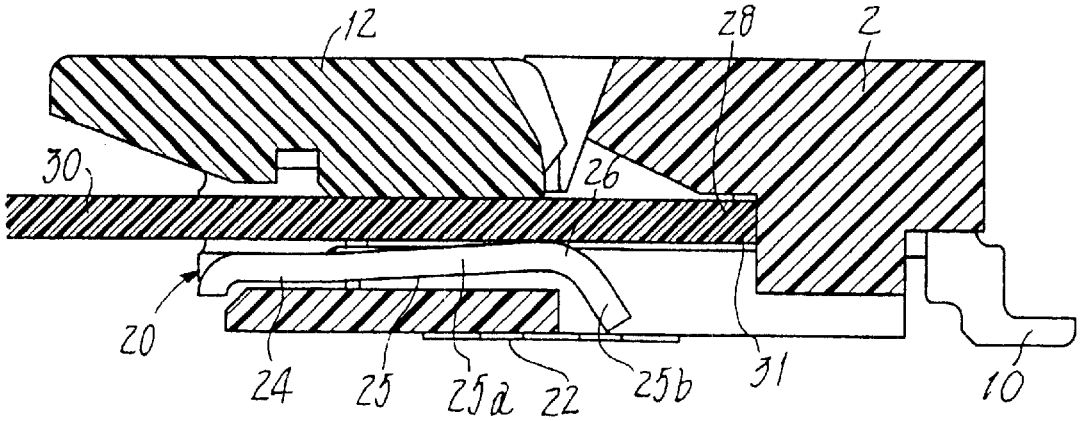
FIG. 8 is likewise an enlarged cross section of the connector, whose resilient support of reinforcement metal is shown relative to the inner end portion of flexible board.

In use of this connector, the pressing means 12 will be swung up at first to open the recess of housing 2 as shown in FIGS. 1 and 2. Then, the fore end portion 31 of a flexible circuit board 30 is placed in the recess 3 and pushed in between the support arms 7 and contact beams 8 of the contacts 6 so as to rest on these beams. In this state, the side edges of the fore end portion of circuit board 30 are elastically urged upwards by the resilient supports 25, as seen in FIG. 5. The fore end portion 31 thus having been brought into a snug engagement with an inner shoulder 28 of the housing 2 will keep the flexible board 30 at its correct position. Thereafter, the pressing means 12 is swung down to lower this board 30 onto the contacts' beams 8 so as to be electrically connected thereto, without fear of suffering from undesirable displacement in any direction (see FIGS. 7 and 8).

Basically, effect of such a retention of said flexible circuit board 30 by the pressing means 12 will depend on the number of contact beams 8, and thus on the number of contacts 6 themselves. However in the present invention, restraint of the flexible board 30 is improved by elastic upward reaction of the resilient supports 25 that are being pressed down by the pressing means 12 through this board 30. The less the number of contacts 6, the more effective such a strengthened retention of the flexible circuit board is thanks to the resilient supports 25, thereby reliably protecting this board 30 from its slipping off or displacement.

Figure 9:
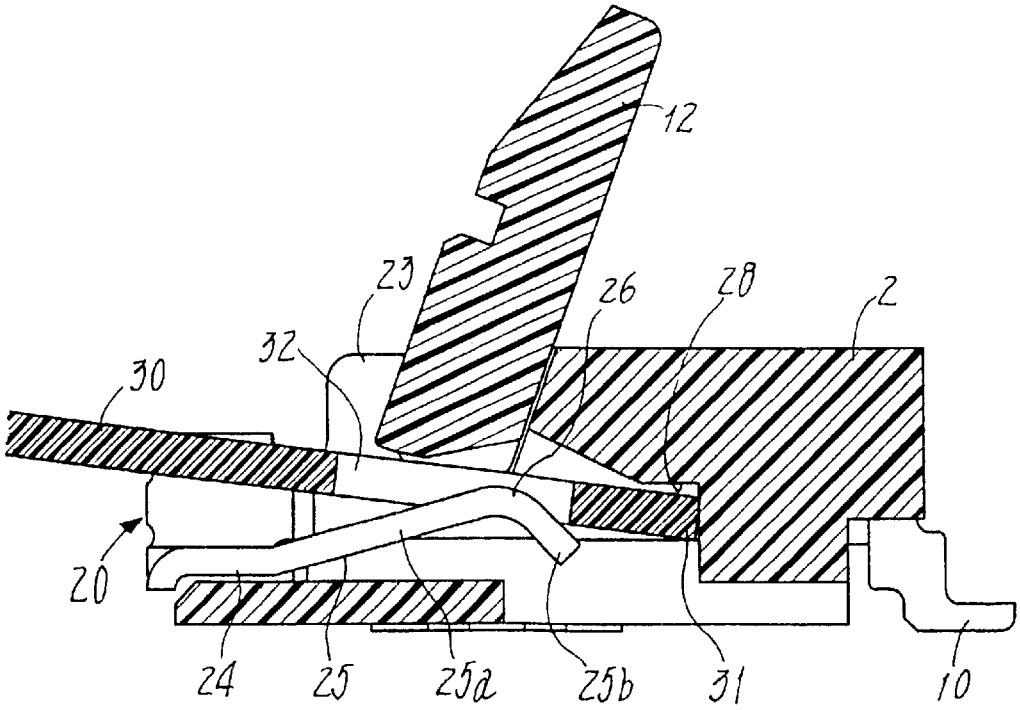
FIG. 9 is an enlarged cross-sectional side elevation of the connector provided in another embodiment, showing the inner end portion of a flexible circuit board inserted in the connector.
Figure 10:
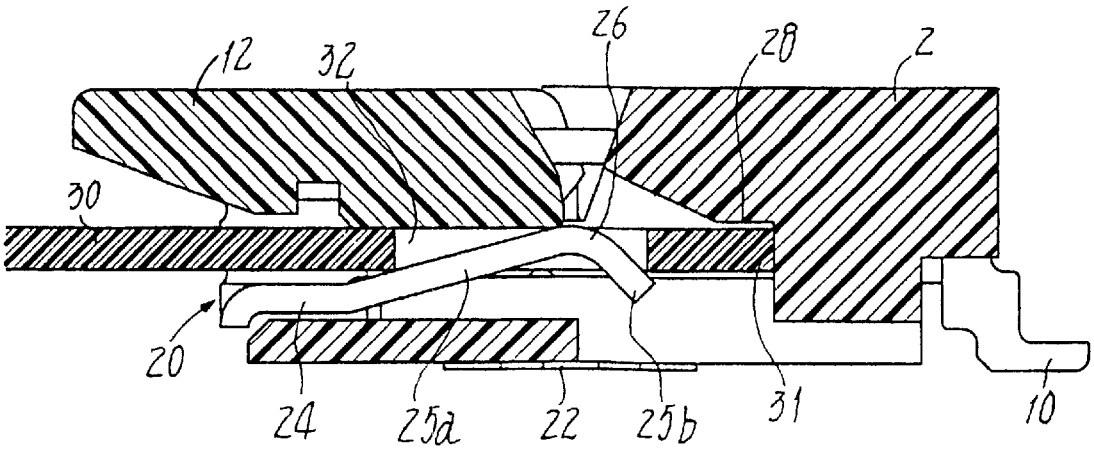
FIG. 10 is likewise an enlarged cross section of the connector, whose resilient support of reinforcement metal is shown relative to the inner end portion of flexible board.

FIGS. 9 and 10 show another embodiment, wherein apertures or cutouts 32 are formed in the lateral sides of flexible board 30 so as receive therein the convex summits 26 of resilient supports 25. This structure will not only prevent the flexible board 30 from slipping off or undesirably moving relative to the housing 2, but also protects this board 30 and/or the connector 1 from damage or breakage. This is because the resilient supports 25 will elastically deform themselves to disengage their convex summits 26 from those apertures or cutouts 32 if and when any impermissible pulling or wrenching force acts on the flexible circuit board 30.

In summary, the connector of the invention comprises reinforcement metals attached to the opposite sides of its housing and each metal has a resilient support to elastically hold in place the lateral sides of a flexible circuit board overlying the contacts of this connector. The flexible board will thus be inhibited from slipping off or displacement relative to the connector, during an operation for ultimately fixing in it the said board. Once the pressing means is closed to take and keep its latched position, a sufficient restraint will be afforded to the flexible board, thereby establishing a reliable electric connection.

In accordance with a modification, the flexible board is protected more surely from slipping off or displacement in the connector, and also this board and/or connector are protected from damage even if any impermissible pulling or wrenching force acts on the flexible circuit board.

In accordence another embodiment, the housing's bearing ends for the pressing means is advantageously strengthened with the reinforcement metals.

What is claimed is:

1. A connector for a flexible circuit board comprising:

a housing;

a pressing means;

a plurality of parallel contacts forming a row;

the housing having a recess in which the contacts each having a conductive arm are disposed at a given pitch;

the pressing means being operable to open and close the recess such that as it closes the recess, an inner end portion of said flexible board overlying the arms will be pressed down thereto;

a pair of reinforcement metals that face one another over the row of the contacts and are attached to opposite sides of the housing, so as to be soldered to a rigid printed circuit board; and a resilient support formed integrally with each reinforcement metal for elastically urging the inner end portion of the flexible board laid on the conductive arms, upwards in a direction away therefrom to keep the board in place.

2. A connector as defined in claim 1, wherein each resilient support smoothly continues from a basal end of each reinforcement metal in a cantilevered fashion, the basal end being located beside the recess of housing so as to face the inner end portion, and wherein each resilient support extends obliquely upwards at first into the housing and is then bent downwards at its inner end region, such that this support assumes a reversed and V-shape.

3. A connector as defined in claim 1, wherein the resilient supports are of such a shape that they engage with apertures or cutouts formed in lateral sides of the flexible board.

4. A connector as defined in claim 1, wherein the pressing means is rotatably connected to the housing and capable of rotation to open and close the recess, and each reinforcement metal has a bearing portion for rotatably supporting the pressing means and reinforcing it.

* * * * *